US007317421B2

(12) United States Patent
Liu

(10) Patent No.: US 7,317,421 B2
(45) Date of Patent: Jan. 8, 2008

(54) ANTENNA MODULE WITH AN ENHANCED ANGULAR COVERAGE

(75) Inventor: I-Ru Liu, Taipei (TW)

(73) Assignee: Accton Technology Corporation, Hsinchu (TW)

( * ) Notice: Subject to any disclaimer, the term of this patent is extended or adjusted under 35 U.S.C. 154(b) by 167 days.

(21) Appl. No.: 11/209,832

(22) Filed: Aug. 24, 2005

(65) Prior Publication Data

US 2007/0052589 A1 Mar. 8, 2007

(51) Int. Cl.
*H01Q 1/38* (2006.01)

(52) U.S. Cl. ..... 343/700 MS; 343/702

(58) Field of Classification Search ..... 343/700 MS, 343/702, 846

See application file for complete search history.

(56) References Cited

U.S. PATENT DOCUMENTS

| | | | | |
|---|---|---|---|---|
| 4,072,952 | A * | 2/1978 | Demko | 343/700 MS |
| 4,922,259 | A * | 5/1990 | Hall et al. | 343/700 MS |
| 5,898,405 | A * | 4/1999 | Iwasaki | 343/700 MS |
| 6,836,247 | B2 * | 12/2004 | Soutiaguine et al. | 343/700 MS |
| 6,940,460 | B2 * | 9/2005 | Maoz et al. | 343/702 |
| 2002/0140612 | A1 * | 10/2002 | Kadambi et al. | 343/702 |
| 2006/0238433 | A1 * | 10/2006 | Chou | 343/795 |

* cited by examiner

*Primary Examiner*—Hoanganh Le
(74) *Attorney, Agent, or Firm*—Rosenberg, Klein & Lee

(57) ABSTRACT

An antenna module includes a substrate with at least a first antenna on one side while at least a second antenna on the other side of the substrate so that both sides of the antenna module are able to radiate signals. Therefore, the effective angular coverage of the antenna module is enlarged and the performance of the embedded wireless network device is improved.

18 Claims, 10 Drawing Sheets

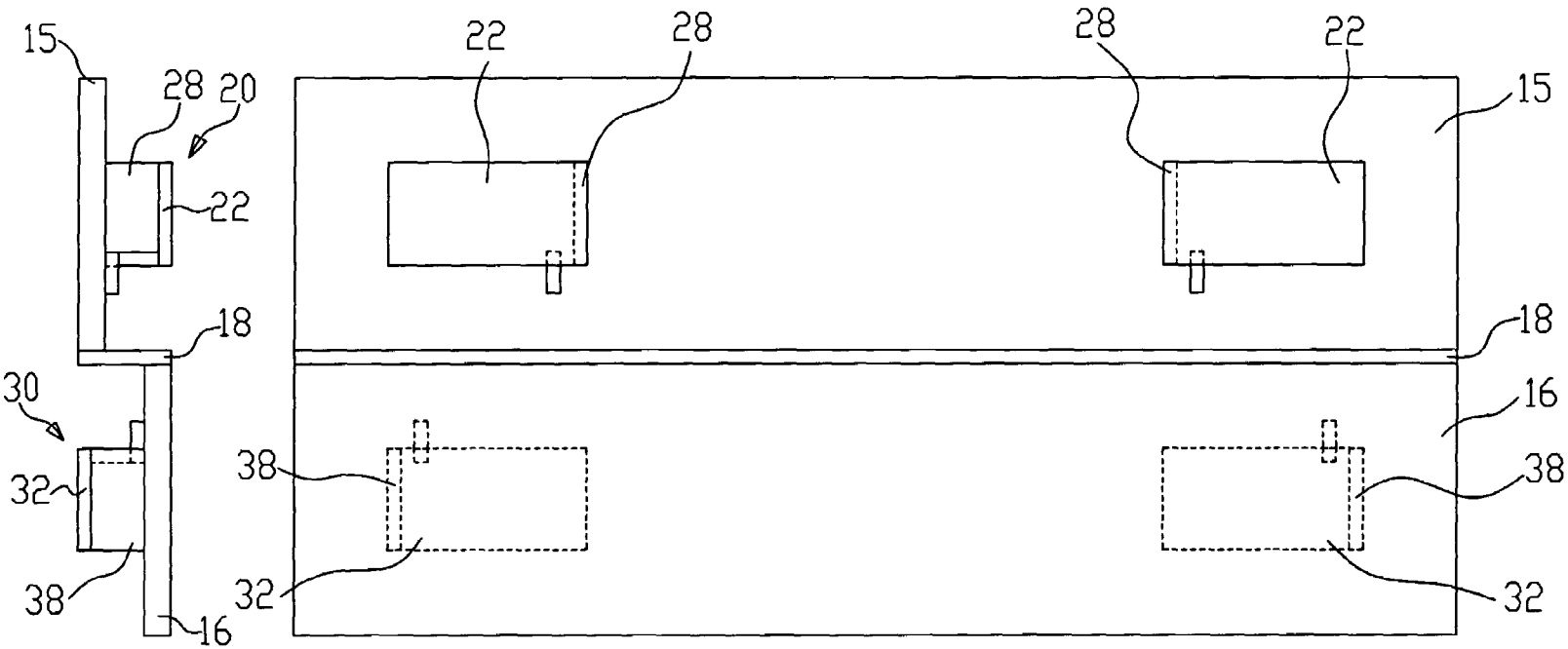
Fig.6A
Fig.6B
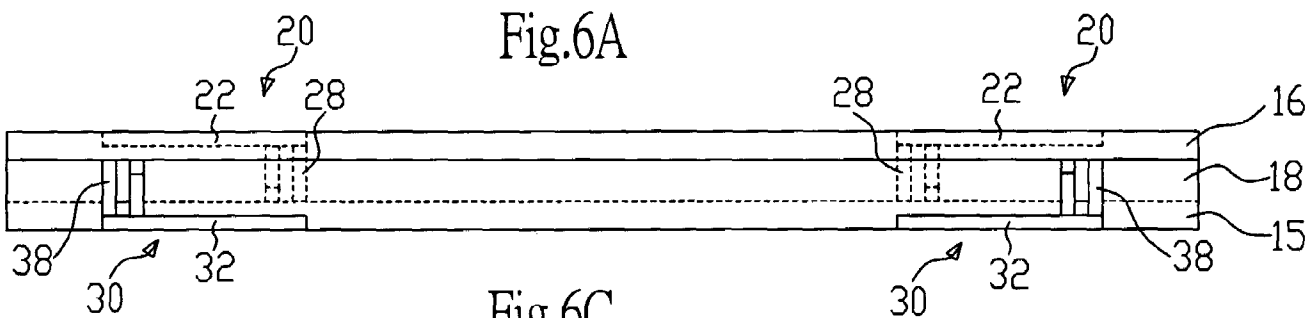
Fig.6C

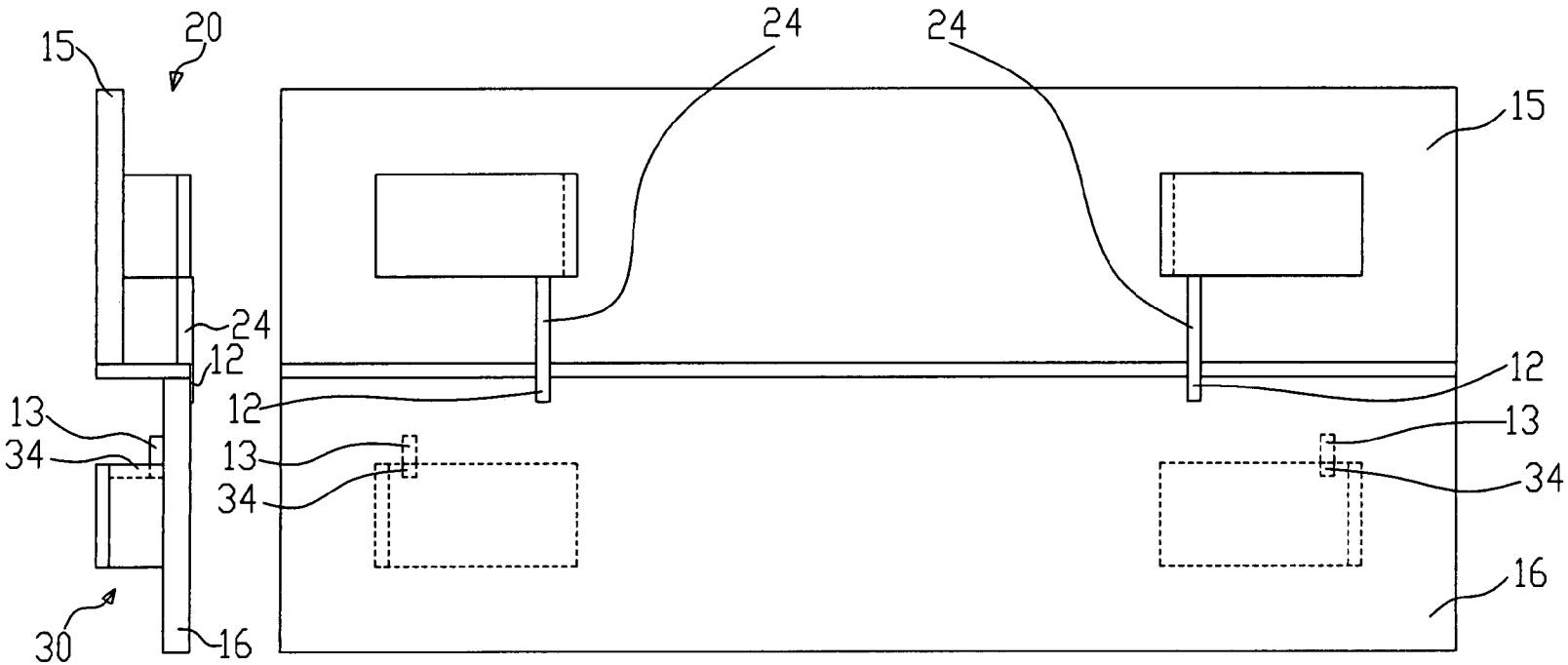
Fig.7A
Fig.7B
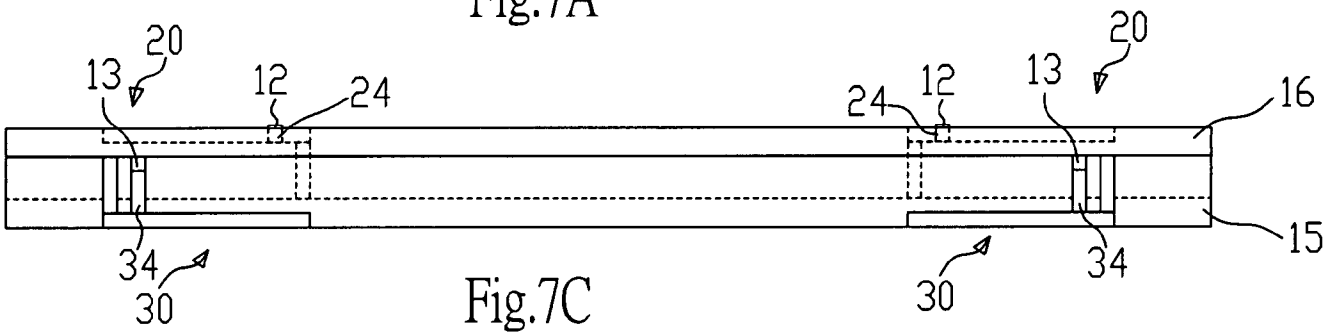
Fig.7C

ANTENNA MODULE WITH AN ENHANCED ANGULAR COVERAGE

BACKGROUND OF THE INVENTION

The present invention relates to an antenna module, especially to a kind of antenna module that radiates signals on two sides of a substrate so as to enlarge the angular coverage of the antenna module.

The purpose of technology is to bring people more convenient life. For example, internet brings people infinite possibilities thus in the era of information explosion, internet is essential to our daily lives. Internet provides us a plurality of services such as communications, shopping, or distance education. In earlier days, internet or intranet sends information by wires. Now wireless transmission by antennas becomes main stream. Without antennas, wireless network devices such as access points or client stations can't transmit or receive information. Therefore, antennas play a key role in wireless network technology.

Nowadays, many of wireless network devices use an embedded antenna module for radiateting signals. A plurality of that antenna is disposed on one side of a substrate. Thus while radiating signals, the range is extended in some directions, due to the reflection of the substrate. But the waves are blocked by the substrate of the antenna module and angular coverage is then restricted on one side of the wireless network devices. Thus the link performance of the wireless network devices is reduced and this causes inconvenience of users. In order to solve above problem, there is a need to propagate signals from the other side of the antenna module so that the link performance of the wireless network devices is enhanced. In applications, the antennas located at same side or at different sides of PCB substrate can be combined for making antenna diversity, beam forming or spatial multiplexing. For instance, antenna diversity of space, pattern or polarization can be easily implemented by using the embodiments of this invention.

SUMMARY OF THE INVENTION

It is therefore a primary object of the present invention to provide an antenna module that transmits and receives signals on two sides of a substrate so as to increase effective angular coverage and further improve the performance of the wireless network devices.

In order to achieve object, an antenna module in accordance with the present invention consists of a substrate, at least a first antenna disposed on one side of the substrate and at least a second antenna arranged at the other side of the substrate. Thus both sides of the antenna module can propagate signals and the effective angular coverage is enlarged. Therefore, the performance of the wireless network devices is enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIG. 6A is a front view of the sixth embodiment in accordance with the present invention;

FIG. 6B is a side view of the sixth embodiment in accordance with the present invention;

FIG. 6C is a bottom view of the sixth embodiment in accordance with the present invention;

FIG. 7A is a front view of the seventh embodiment in accordance with the present invention;

FIG. 7B is a side view of the seventh embodiment in accordance with the present invention;

FIG. 7C is a bottom view of the seventh embodiment in accordance with the present invention;

DETAILED DESCRIPTION OF THE PREFERRED EMBODIMENT

Figure 1A:
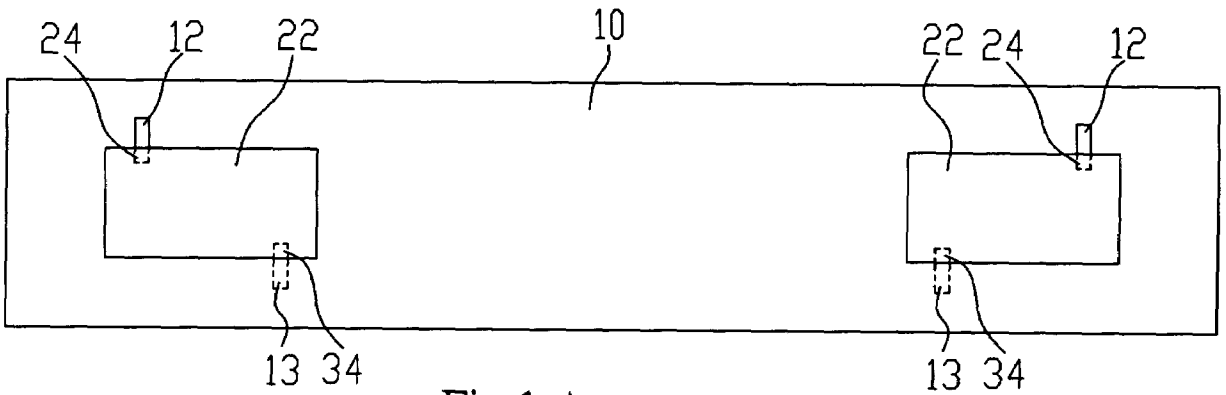
FIG. 1A is a front view of the first embodiment in accordance with the present invention.
Figure 1B:
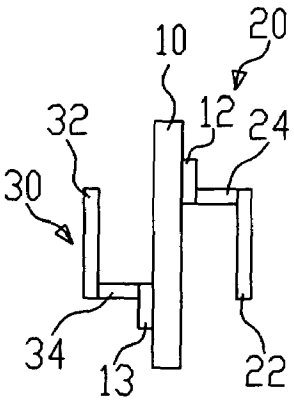
FIG. 1B is a side view of the first embodiment in accordance with the present invention.
Figure 1C:
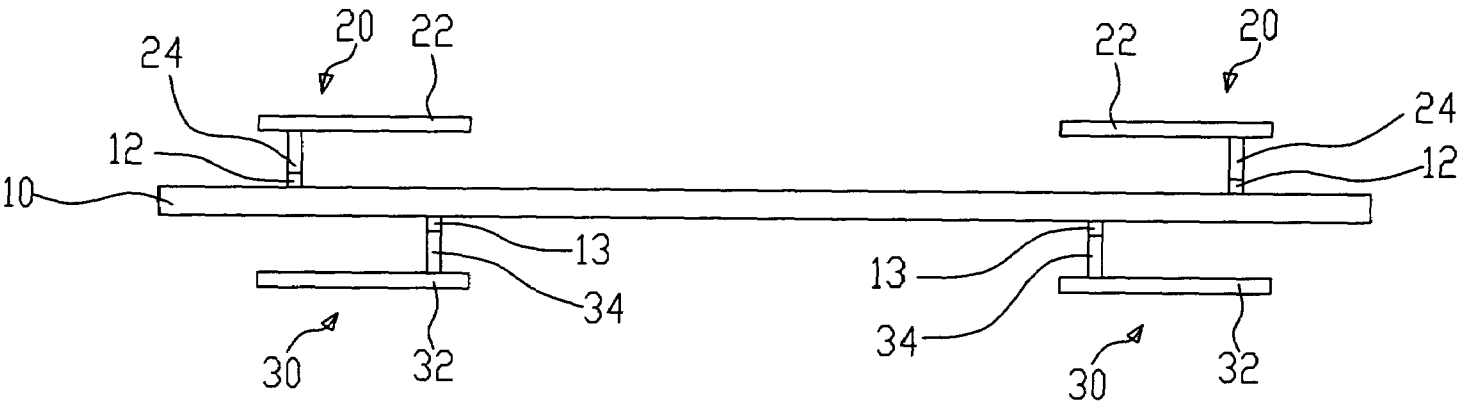
FIG. 1C is a bottom view of the first embodiment in accordance with the present invention.

Refer to FIG. 1A, FIG. 1B & FIG. 1C, an antenna module according to the present invention is composed by a substrate 10, a plurality of first antennas 20 and a plurality of second antennas 30. The substrate 10 is a circuit board. The first antenna 20 is disposed on one side of the substrate 10 while the second antenna 30 is installed on the other side of the substrate 10. The first antenna 20 and the second antenna 30 are one-half wavelength rectangular patch antennas. Each of the first antenna 20 and the second antenna 30 is arranged with a radiator element 22, 32 and a feeding element 24, 34 respectively. The feeding elements 24, 34 are strip probe or cylinder probe feeding elements. One end of the feeding element 24 is connected to the radiator element 22 and the other end thereof is joined with a transmission line 12 disposed on the substrate 10. Similarly, one end of the feeding element 34 is connected to the radiator element 32 and the other end thereof is joined with a transmission line 13 set on the substrate 10. The transmission line 12, 13 is transmission line of printed circuit boards' such as a Strip-line, a Micro-strip line, or a Coplanar-Waveguide transmission line. Both sides of the substrate 10 of the antenna module in accordance with the present invention can propagate signals so that the effective angular coverage of the antenna module is increased and so does the performance of the wireless network device wherein the antenna module is embedded.

Figure 2A:
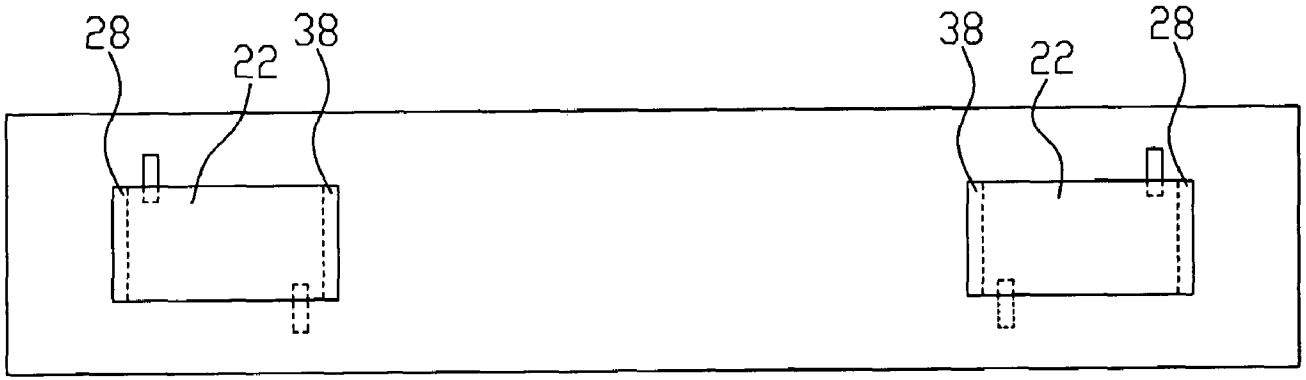
FIG. 2A is a front view of the second embodiment in accordance with the present invention.
Figure 2B:
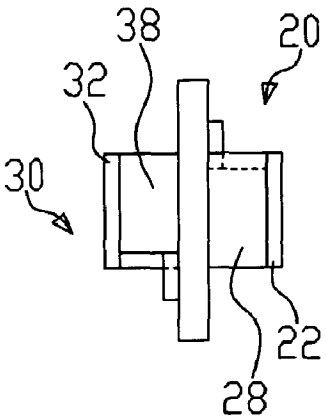
FIG. 2B is a side view of the second embodiment in accordance with the present invention.
Figure 2C:
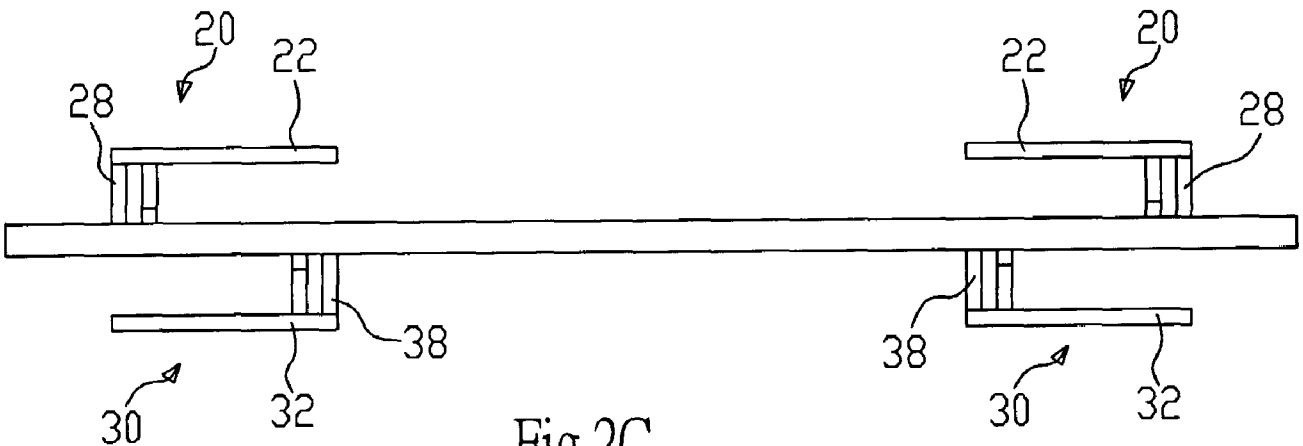
FIG. 2C is a bottom view of the second embodiment in accordance with the present invention.

The first antenna 20 and the second antenna 30 mentioned above can also be one-fourth wavelength rectangular patch antennas, as shown in FIG. 2A, FIG. 2B, and FIG. 2C. The difference between this embodiment and above embodiment is in that each of the first antenna 20 and the second antenna 30 of this embodiment is arranged with a grounding element 28, 38 respectively. The grounding element 28, 38 is a broad strip grounding element. One end of the grounding element 28, 38 is joined with the radiator element 22, 32 while the other end of the grounding element 28, 38 is connected to a ground on two sides of the substrate 10.

Figure 3A:
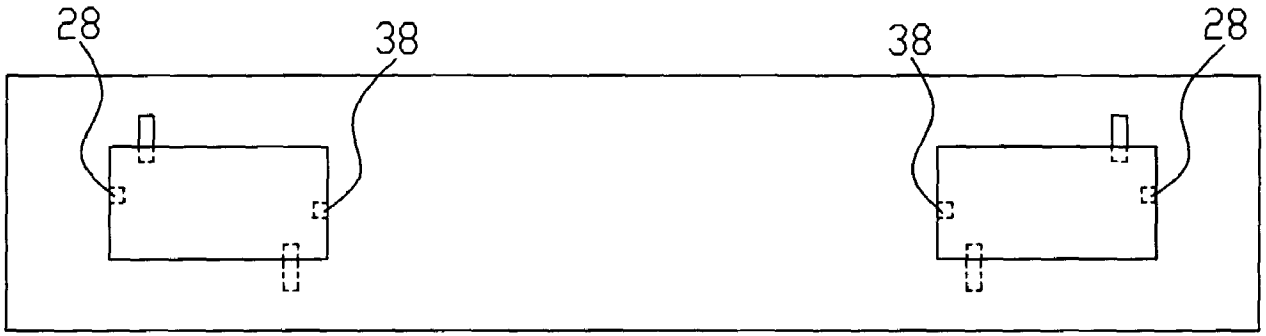
FIG. 3A is a front view of the third embodiment in accordance with the present invention.
Figure 3B:
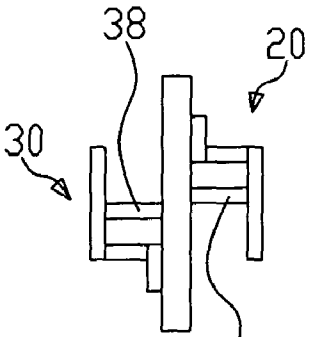
FIG. 3B is a side view of the third embodiment in accordance with the present invention.
Figure 3C:
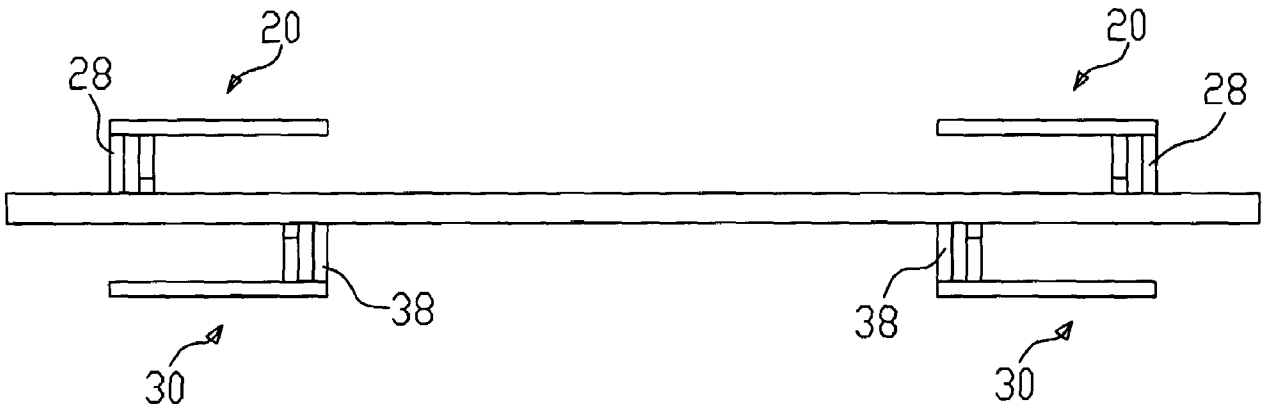
FIG. 3C is a bottom view of the third embodiment in accordance with the present invention.

FIG. 3A, FIG. 3B, & FIG. 3C are front view, side view and bottom view of another embodiment in accordance with the present invention. As shown in figure, the difference between this embodiment and above embodiment is in that the first antenna 20 and the second antenna 30 are Planar Inverted F Antennas (PIFA) and the grounding elements 28, 38 of the first antenna 20 and the second antenna 30 are narrow strip grounding elements.

Figure 4A:
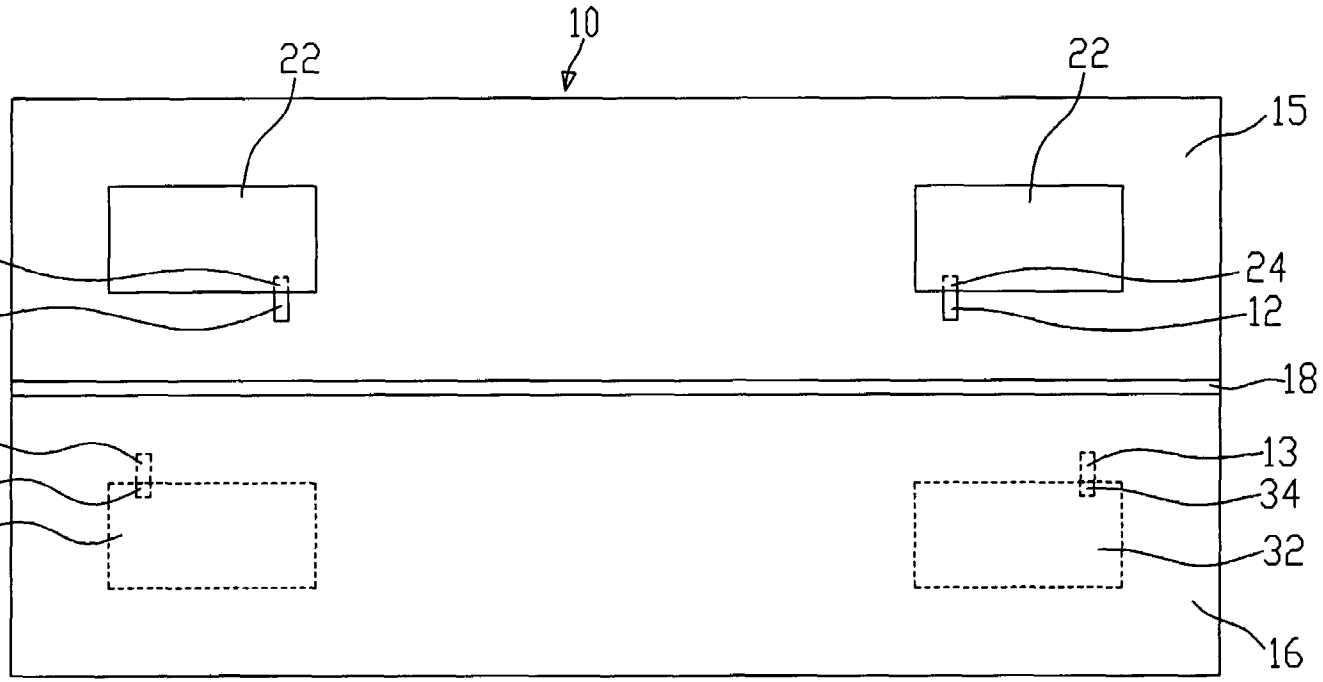
FIG. 4A is a front view of the fourth embodiment in accordance with the present invention.
Figure 4B:
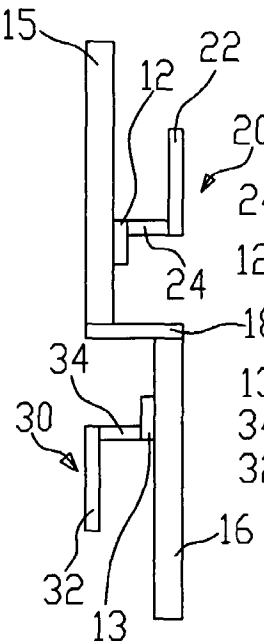
FIG. 4B is a side view of the fourth embodiment in accordance with the present invention.
Figure 4C:
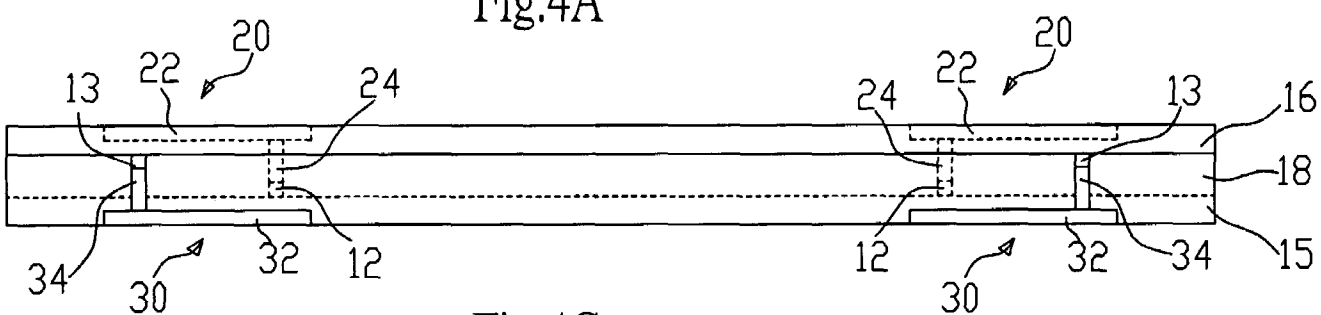
FIG. 4C is a bottom view of the fourth embodiment in accordance with the-present invention.

Refer to FIG. 4A, FIG. 4B & FIG. 4C, a further embodiment is shown. The difference between this embodiment and the first embodiment is in that the substrate 10 consists of a first circuit board 15 and a second circuit board 16. A conductor 18 is arranged between the first circuit board 15 and the second circuit board 16 so as to achieve electrically connection between the first circuit board 15 and the second circuit board 16. The conductor 18 can be implemented by a metal trip or by a line of conductive through holes. The first antenna 20 is installed at one side of the first circuit board 15 while the second antenna 30 is set on one side of the second circuit board 16. That is the first antenna 20 and the second antenna 30 is disposed on two sides of the substrate 10 respectively.

The feeding elements 24, 34 of the first antenna 20 and the second antenna 30 are disposed between the corresponding radiator elements 22, 32 and the transmission lines 12, 13 of the circuit boards 15, 16. One end of the feeding element 24 of the first antenna 20 is connected to the radiator elements 22 and the other end thereof is connected to the transmission line 12 of the first circuit board 15. While one end of the feeding element 34 on the second antenna 30 is connected to the radiator elements 32 and the other end of the feeding element 34 is connected to the transmission line 13 of the second circuit board 16. The thickness of the antenna module of this embodiment is thinner than that of the antenna module of above embodiment so that this embodiment not only provides a PCB stack-up to radiate signals on two sides of the substrate 10 but also reduces the dimension of the antenna module.

Figure 5A:
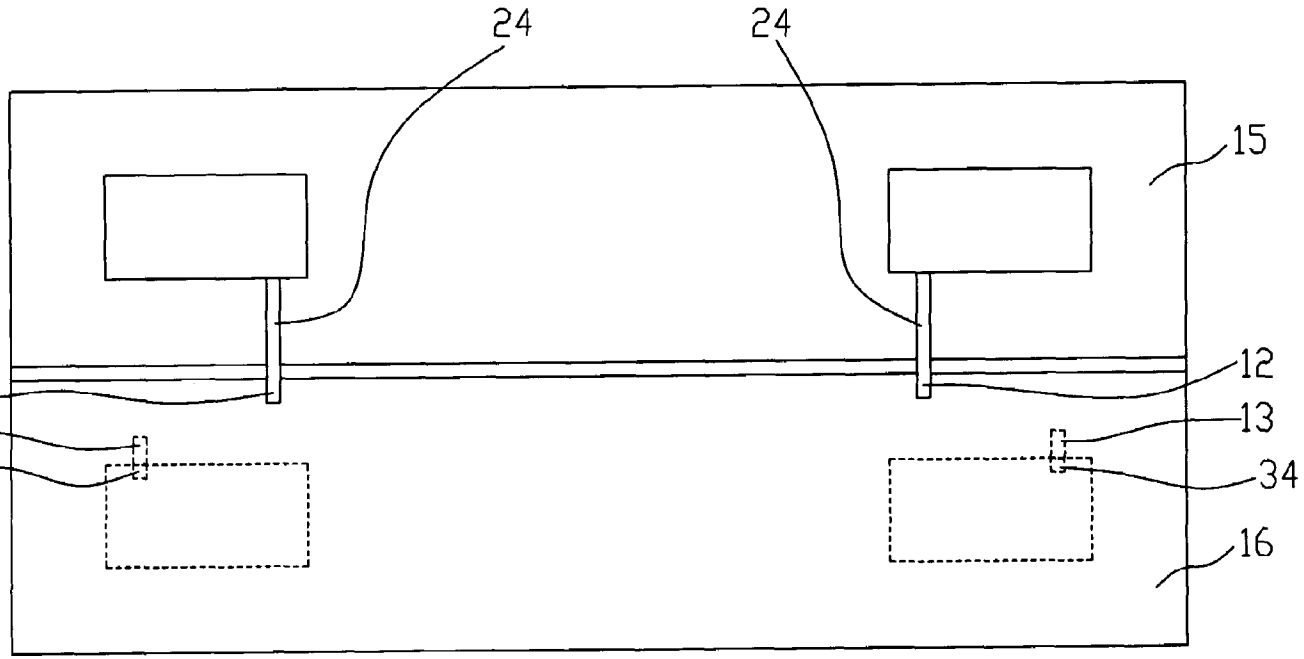
FIG. 5A is a front view of the fifth embodiment in accordance with the present invention.
Figure 5B:
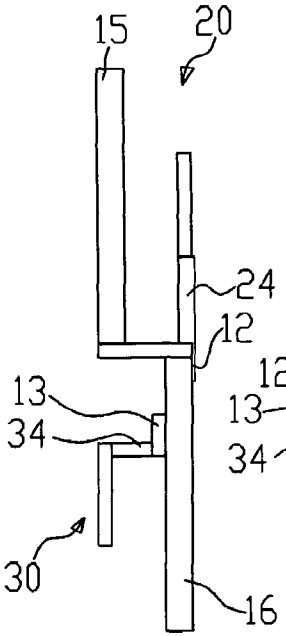
FIG. 5B is a side view of the fifth embodiment in accordance with the present invention.
Figure 5C:
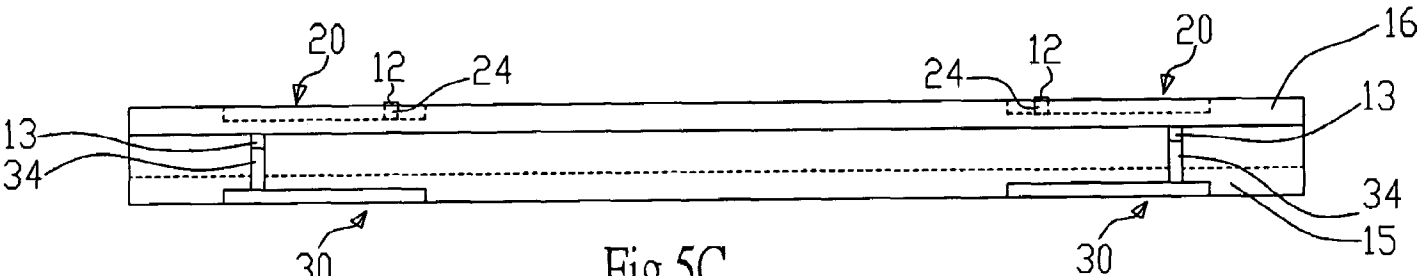
FIG. 5C is a bottom view of the fifth embodiment in accordance with the present invention.

Refer to FIG. 5A, FIG. 5B & FIG. 5C, a fifth embodiment of the present invention is disclosed. The difference between this embodiment and the fourth embodiment is in that both the transmission line 12 and the feeding element 24 of the first antenna 20 are integrated with each other and then is disposed on the second circuit board 16. Similarly, both the transmission line 13 and the feeding element 34 of the second antenna 30 are integrated with each other and then is arranged on the first circuit board 15. Therefore, the antenna modules can be manufactured more efficiently.

Refer to FIG. 6A, FIG. 6B & FIG. 6C, a sixth embodiment of the present invention is disclosed. As shown in figure, the first antenna 20 and the second antenna 30 of this embodiment are one-fourth wavelength rectangular patch antennas. Thus the difference between this embodiment and the fourth embodiment is in that the first antenna 20 and the second antenna 30 of this embodiment are disposed with grounding elements 28, 38, the same with the second embodiment. The grounding elements 28, 38 are broad strip rounding devices. The grounding elements 28, 38 are set between the corresponding radiator elements 22, 32 and rounds of the circuit boards 15, 16. One end of the grounding element 28 is connected to the radiator element 22 and the other end thereof is joined with a ground of the first circuit board 15. And one end of the grounding element 38 is connected to the radiator element 32 while the other end thereof is joined with a ground of the second circuit board 16. The ground of the first circuit board 15 and the ground of the second circuit board 16 are electrically connected by a conductor 18. The grounding element 28, 38 can be integrated with the conductor 18 so as to make the manufacturing of the antenna module in accordance with the present invention more efficient.

Refer to FIG. 7A, FIG. 7B, & FIG. 7C, the difference between this embodiment and the sixth embodiment is in that the transmission line 12 and the feeding element 24 of the first antenna 20 are integrated with each other and then arranged on the second circuit board 16. The transmission line 13 and the feeding element 34 of the second antenna 30 are also integrated and then installed on the first circuit board 15 in similar way.

Figure 8A:
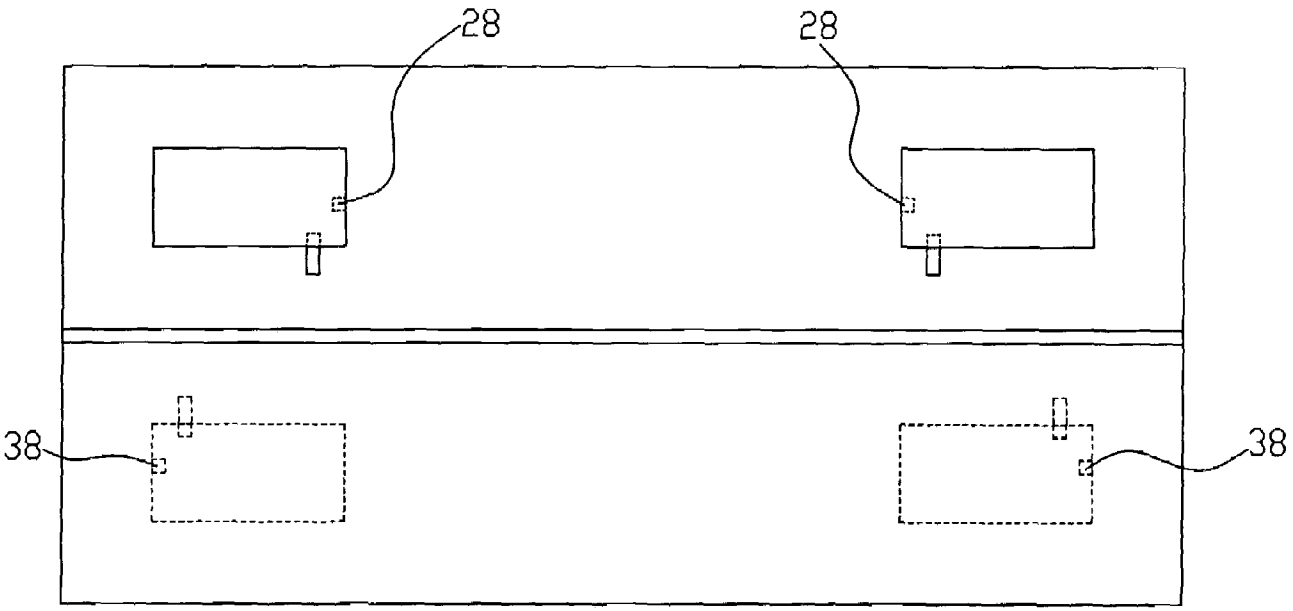
FIG. 8A is a front view of the eighth embodiment in accordance with the present invention.
Figure 8B:
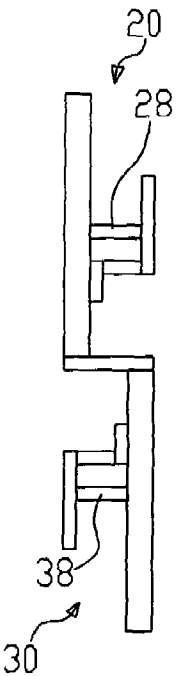
FIG. 8B is a side view of the eighth embodiment in accordance with the present invention.
Figure 8C:
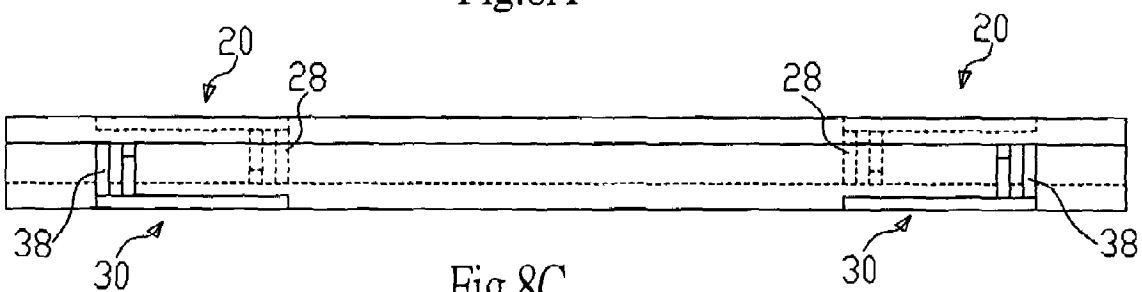
FIG. 8C is a bottom view of the eighth embodiment in accordance with the present invention.

Refer to FIG. 8A, FIG. 8B, & FIG. 8C, the first antenna 20 and the second antenna 30 of this embodiment are Planar Inverted F Antennas. The difference between this embodiment and the sixth embodiment is in that grounding elements 28, 38 of this embodiment are narrow strip grounding elements.

Figure 9A:
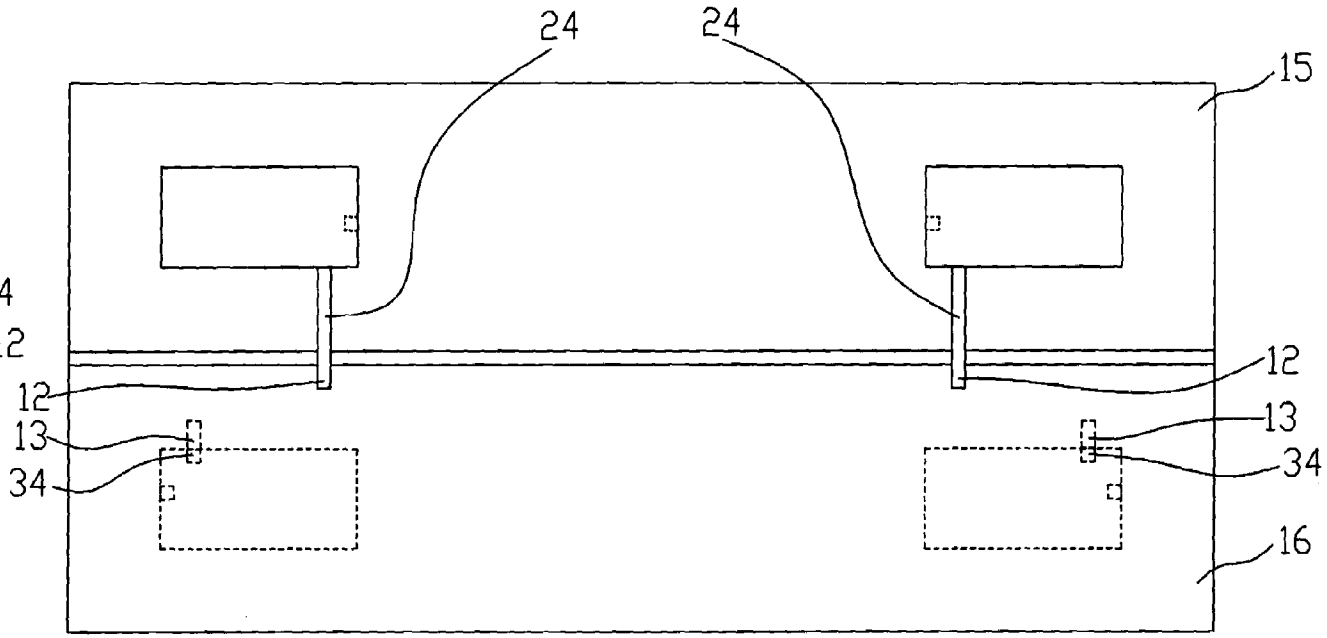
FIG. 9A is a front view of the ninth embodiment in accordance with the present invention.
Figure 9B:
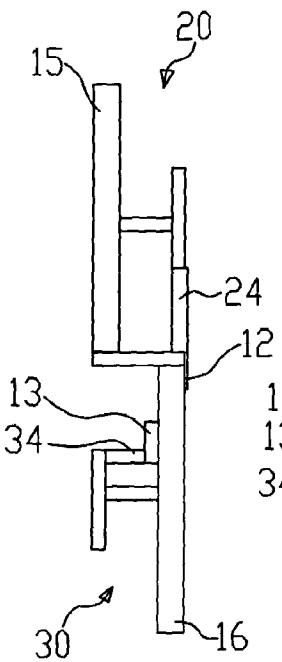
FIG. 9B is a side view of the ninth embodiment in accordance with the present invention.
Figure 9C:
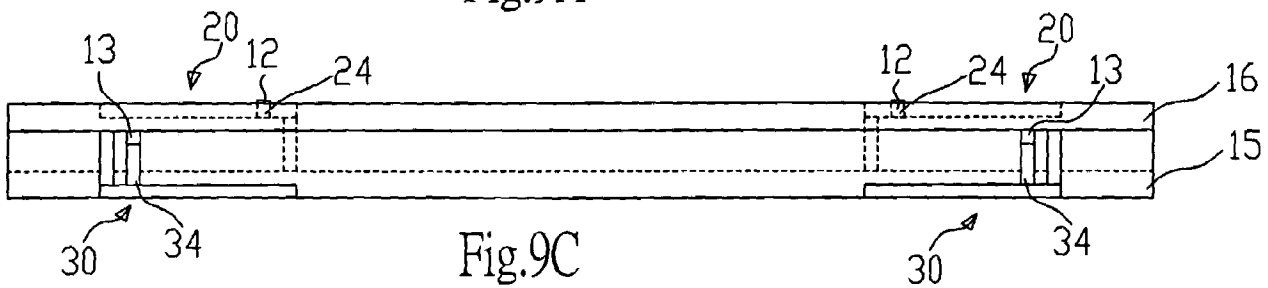
FIG. 9C is a bottom view of the ninth embodiment in accordance with the present invention.

Refer to FIG. 9A, FIG. 9B, & FIG. 9C, the difference between this embodiment and the sixth embodiment is in that the transmission line 12 and the feeding element 24 of the first antenna 20 of this embodiment are integrated and then arranged on the second circuit board 16. In similar way, the transmission line 13 is also integrated with the feeding element 34 of the second antenna 30 and then disposed on the first circuit board 15.

Figure 10A:
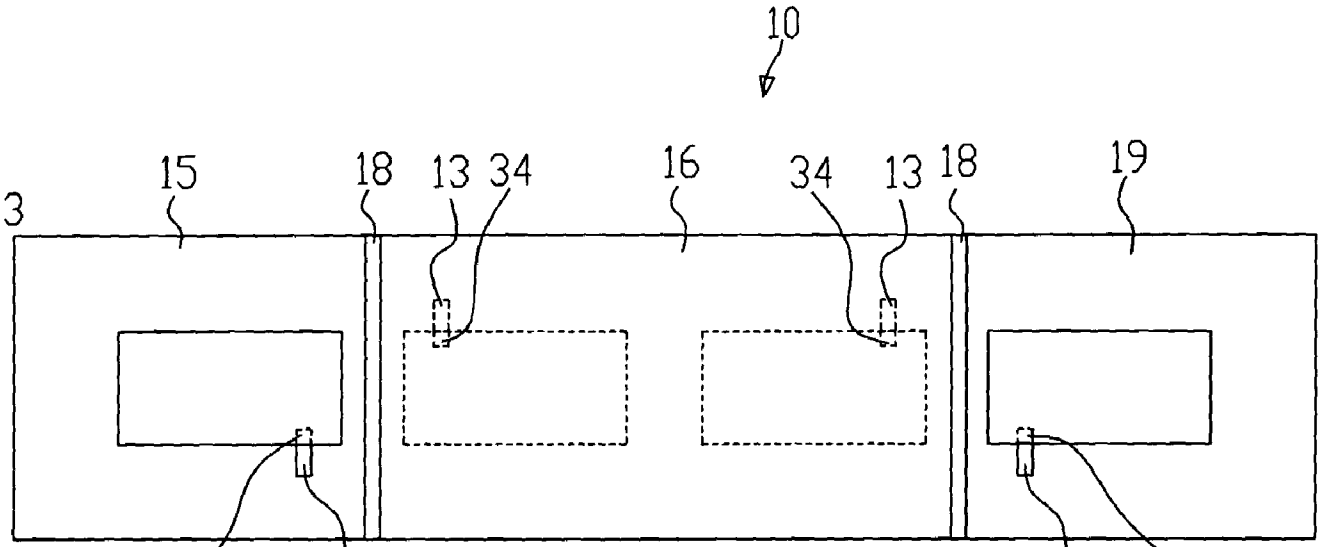
FIG. 10A is a front view of the tenth embodiment in accordance with the present invention.
Figure 10B:
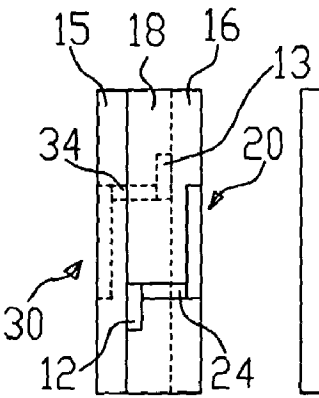
FIG. 10B is a side view of the tenth embodiment in accordance with the present invention.
Figure 10C:
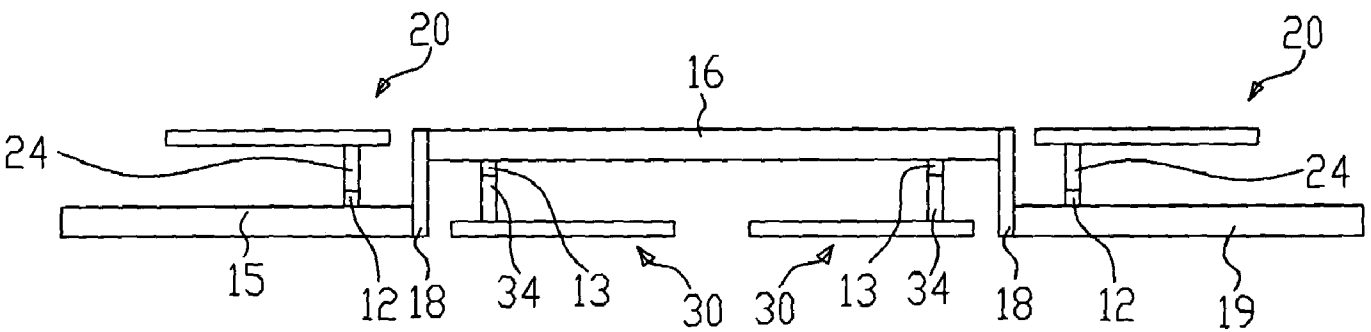
FIG. 10C is a bottom view of the tenth embodiment in accordance with the present invention.

Refer to FIG. 10A, FIG. 10B, & FIG. 10C, the substrate 10 is composed by the first circuit board 15 and the second circuit board 16 and a third circuit board 19. The conductor 18 is arranged between the first circuit board 15 and the second circuit board 16 while there is also another conductor 18 disposed between the second circuit board 16 and the third circuit board 19 so that the first circuit board 15 and the second circuit board 16 are electrically connected. The second circuit board 16 and the third circuit board 19 are also electrically connected. The first antennas 20 are disposed on one side of the first circuit board 15 and one side of the third circuit board 19 respectively while the second antenna 30 is installed on one side of the second circuit board 16. Therefore, the first antennas 20 and the second antenna 30 are disposed on two sides of the substrate 10 respectively.

In this embodiment, the first antenna 20 and the second antenna 30 are one-half wavelength rectangular patch antennas while the first antennas 20 and the second antenna 30 can be different types of antennas disposed on the circuit boards 15, 16, 19 as shown in above embodiment. For example, the first antennas 20 and the second antenna 30 can be one-fourth wavelength rectangular patch antennas or Planar Inverted F Antennas. Moreover, the transmission line 12 is integrated with the feeding element 24 of the first antenna 20 and then arranged on the second circuit board 16. Or the transmission line 13 is integrated with the feeding element 34 of the second antenna 30 and then disposed on the first circuit board 15 and the third circuit board 19. Furthermore, when the first antennas 20 and the second antenna 30 are one-fourth wavelength rectangular patch antennas or Planar Inverted F Antennas, the grounding element 28 of the first antenna 20 as well as the grounding element 38 of the second antenna 30 is integrated with the conductor 18. Thus there is a large flexibility on manufacturing of the present invention. In addition, the substrate 10 of the antenna module may include a fourth circuit board or a fifth circuit board according to system requirements.

In summary, a first antenna and a second antenna are respectively disposed on two side of a substrate of an antenna module according to the present invention so as to make both sides of the antenna module radiate signals. Thus the effective angular coverage of the antenna module is enlarged and the performance of the wireless network device wherein the antenna module is embedded is then further enhanced.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An antenna module comprising:

a substrate;

at least one first antenna disposed on one side of the substrate;

at least one second antenna disposed on another side of said substrate opposite to said one side thereof;

wherein each of said at least one first antenna and said at least one second antenna includes a radiator element positioned in a spaced relationship with a respective one of said one and another sides of said substrate, a transmission line extending on a surface of said respective side of said substrate, and a feeding element, wherein one end of the feeding element is connected to the radiator element, and another end of the feeding element is coupled to said transmission line on the substrate.

2. The module as claimed in claim 1, wherein the substrate is a circuit board.

3. The module as claimed in claim 1, wherein the feeding element is a strip or cylinder feeding element.

4. The module as claimed in claim 1, wherein the first antenna or the second antenna is a rectangular patch antenna.

5. The module as claimed in claim 4, wherein the rectangular patch antenna is a one-half wavelength antenna or a one-fourth wavelength antenna.

6. The module as claimed in claim 5, wherein the one-fourth wavelength antenna has a grounding element, one end of the grounding element being connected to the radiator element and the other end of the grounding element being joined with a ground of the substrate.

7. The module as claimed in claim 6, wherein the grounding element is a broad strip grounding element.

8. The module as claimed in claim 1, wherein the first antenna or the second antenna is a Planar Inverted F Antenna.

9. The module as claimed in claim 8, wherein the Planar Inverted F Antenna has a grounding element, one end of the grounding element being connected to the radiator element, and the other end of the grounding element being joined with a ground of the substrate.

10. The module as claimed in claim 9, wherein the grounding element is a narrow strip grounding element.

11. The module as claimed in claim 1, wherein the substrate includes a first circuit board and a second circuit board, and a conductor disposed between the first circuit board and the second circuit board, the first antenna being arranged on a respective side of the first circuit board, and the second antenna being installed on a respective side of the second circuit board.

12. The module as claimed in claim 11, wherein the feeding element of the first antenna is integrated with the transmission line and arranged on the second circuit board.

13. The module as claimed in claim 11, wherein the first antenna or the second antenna is a one-fourth wavelength patch antenna having a grounding element, one end of the grounding element being connected to the radiator element, and the other end of the grounding element being connected to a corresponding ground of the circuit board, wherein the grounding element is integrated with the conductor.

14. The device as claimed in claim 11, wherein the first antenna or the second antenna is a Planar Inverted F Antenna having a grounding element, one end of the grounding element being connected to the radiator element, and the other end of the grounding element being connected to a corresponding ground of the circuit board, wherein the grounding element is integrated with the conductor.

15. The module as claimed in claim 1, wherein the substrate includes:

a first circuit board, a second circuit board, and a third circuit board; and a conductor disposed between the first circuit board and the second circuit board as well as between the second circuit board and the third circuit board; each of the first antenna being arranged on one side of the first circuit board and one side of the third circuit board respectively, while the second antenna being installed on one side of the second circuit board.

16. The module as claimed in claim 15, wherein the feeding element of the first antenna is integrated with the transmission line and positioned on the second circuit board.

17. The module as claimed in claim 15, wherein the first antenna or the second antenna is a one-fourth wavelength patch antenna having a grounding element, one end of the grounding element being connected to the radiator element, and the other end of the grounding element being connected to a corresponding ground of the circuit board, wherein the grounding element is integrated with the conductor.

18. The module as claimed in claim 15, wherein the first antenna or the second antenna is a Planar Inverted F Antenna having a grounding element, one end of the grounding element being connected to the radiator element, and the other end of the grounding element being connected to a corresponding ground of the circuit board, wherein the grounding element is integrated with the conductor.

* * * * *